United States Patent [19]

Oka et al.

[11] Patent Number: 4,848,766

[45] Date of Patent: Jul. 18, 1989

[54] GOLF BALL

[75] Inventors: Kengo Oka, Nishinomiya; Kaname Yamada, Kakogawa, both of Japan

[73] Assignee: Sumitomo Rubber Industries, Ltd., Hyogo, Japan

[21] Appl. No.: 837,258

[22] Filed: Mar. 7, 1986

[30] Foreign Application Priority Data

Sep. 30, 1985 [JP] Japan ..... 60-218758

[51] Int. Cl.[4] ..... A63B 37/14

[52] U.S. Cl. ..... 273/232; 273/218

[58] Field of Search ..... 273/232

[56] References Cited

U.S. PATENT DOCUMENTS

| | | | |
|---|---|---|---|
| 878,254 | 2/1908 | Taylor | 273/232 |
| 4,142,727 | 3/1979 | Shaw et al. | 273/232 |
| 4,560,168 | 12/1985 | Aoyama | 273/232 |
| 4,720,111 | 1/1988 | Yamada | 273/232 |
| 4,729,567 | 3/1988 | Oka et al. | 273/232 |

FOREIGN PATENT DOCUMENTS

| | | | |
|---|---|---|---|
| 0159550 | 3/1985 | European Pat. Off. . | |
| 2640056 | 9/1976 | Fed. Rep. of Germany . | |
| 2936978 | 3/1980 | Fed. Rep. of Germany | 273/232 |
| 3018853 | 11/1980 | Fed. Rep. of Germany | 273/232 |
| 3439132 | 5/1985 | Fed. Rep. of Germany | 273/232 |
| 5957675 | 6/1977 | Japan . | |
| 115330 | 10/1978 | Japan | 273/232 |
| 6096272 | 1/1980 | Japan . | |
| 107170 | 12/1980 | Japan . | |
| 377354 | 7/1932 | United Kingdom | 273/232 |
| 1415413 | 11/1975 | United Kingdom | 273/232 |
| 2103939 | 2/1983 | United Kingdom | 273/232 |
| 2148132 | 7/1984 | United Kingdom . | |

*Primary Examiner*—George J. Mario

*Attorney, Agent, or Firm*—Birch, Stewart, Kolasch & Birch

[57] ABSTRACT

An improved golf ball which includes a golf ball main body, and large dimples having a large diameter A and small dimples having a small diameter B which are formed in a large number on the peripheral surface of the golf ball main body. The large and small dimples are provided in the ratio of the diameters A/B within the range of 1.25 to 1.50.

5 Claims, 9 Drawing Sheets

| | EMBODIMENT NO. 1 | COMP. EX. 2 | COMP. EX. 3 |
|---|---|---|---|
| NO. OF DIMPLES | 336 | 336 | 336 |
| A/B | 1.32 | 1.19 | 1.61 |
| C | 0.11mm | 0.01mm | 0.01mm |

| EMBODIMENT NO. 1 | | COMP. EX. 2 | COMP. EX. 3 |
|---|---|---|---|
| NO. OF DIMPLES | 336 | 336 | 336 |
| A/B | 1.32 | 1.19 | 1.61 |
| C | 0.11 mm | 0.01 mm | 0.01 mm |

| | EMBODIMENT NO. 2 | EMBODIMENT NO. 3 |
|---|---|---|
| NO. OF DIMPLES | 336 | 336 |
| A/B | 1.32 | 1.45 |
| C | 0.11 | 0.01 |

COMPARATIVE EXAMPLE I

| | |
|---|---|
| NO. OF DIMPLES | 336 |
| A/B | 1.0 |
| C | 0.16 |

EMBODIMENT NO. 4

| | |
|---|---|
| NO. OF DIMPLES | 380 |
| A/B | 1.4 |
| C | 0.04 |

COMPARATIVE EXAMPLE 4

| | |
|---|---|
| NO. OF DIMPLES | 380 |
| A/B | 1.00 |
| C | 0.04 |

EMBODIMENT NO. 5

| | |
|---|---|
| NO. OF DIMPLES | 416 |
| A/B | 1.37 |
| C | 0 |

COMPARATIVE EXAMPLE 5

| | |
|---|---|
| NO. OF DIMPLES | 416 |
| A/B | 1.00 |
| C | 0 |

COMPARATIVE EXAMPLE 6

NO. OF DIMPLES 360

GOLF BALL

BACKGROUND OF THE INVENTION

The present invention generally relates to a golf ball, and more particularly, to a golf ball provided with improved dimples.

Conventionally, with respect to the pattern or configuration of dimples on a golf ball, there have been proposed or actually executed many techniques mainly for the purpose of improving flight performance of the golf ball.

Such conventional techniques as referred to above may be broadly divided into one technique which intends to optimize individual shapes of uniform dimples (i.e., diameter, depth, cross sectional shape, etc. of the dimple) as disclosed, for example, in Japanese Laid-Open patent applications Tokkaisho Nos. 60-96272 and 58-25180, etc., and the other technique which defines the interval or pitch between dimples within a predetermined range as disclosed, for example, in Japanese patent Publication Tokkosho No. 58-50744 and Japanese Laid-Open patent Publication Tokkaisho No. 53-115330, and another technique which proposes a mode for arranging all the dimples at an equal pitch as shown in Japanese Laid-Open patent application Tokkaisho No. 57-107170, etc.

What is common to these known techniques is that they are based on the assumption that the individual dimple dimensions are the same for all. Originally, since the golf ball is a spherical body which flies in a golf game at high speeds of 40 to 80 m/sec, and also through rotation at high speeds of 2,000 to 10,000 rpm, it has been conventionally thought that the dimensions concave and convex portions or undulations on the spherical surface of the golf ball affect the force of air flow.

Meanwhile, the role of dimples in a golf ball resides in one point that such dimples reduce the pressure resistance by accelerating the transition of a turbulent flow at the boundary layer to cause a turbulent flow separation, thereby shifting the separating point backwards as compared with laminar flow separation in a golf ball without having any dimples, so as to decrease the separating region for the consequent reduction of pressure resistance, and in the other point that the lift is improved by increasing the difference between the high and low separating points. Moreover, such role must be effectively utilized all through the range from a low speed to a high speed.

However, as shown in FIG. 9, in a prior art golf ball in which dimples "a" having the similar shapes and dimensions are arranged on the peripheral surface of a ball main body, air flows tend to differ from place to place on the surface of the golf ball, and when air flows at cross sections e—e, f—f and g—g intersecting at right angles with a rotary axis b are observed (in FIG. 9 showing the golf ball during flying as seen from above, an arrow H indicates the direction of flight), it is considered that the air flows at the respective cross sections e—e, f—f and g—g interfere with each other, thus undesirably reducing the effect of the dimples. More specifically, during flight in the direction of the arrow H, positions of the separating point E for the cross section e—e, separating point F for the cross section f—f, and separating point G for the cross section g—g, are altered to a large extent (due to the marked difference in the degree of the undulation on the golf ball surface at the respective cross sections), and the air flow at the cross section f—f tends to obstruct the air flows at the cross sections e—e and g—g, thus reducing the dimple effect. On the other hand, it is considered that the air flows respectively at the cross sections e—e, f—f and g—g tend to be stabilized and settled by themselves based on the dimple shape so as to affect the flight of the golf ball from hitting to falling. Therefore, even if it is attempted to optimize the golf ball performance by altering the pattern, pitch, etc. of the conventional similar dimples as shown in FIG. 9, a desired performance can not be sufficiently achieved.

SUMMARY OF THE INVENTION

Accordingly, an essential object of the present invention is to provide a golf ball provided with improved dimples, including dimples with a large diameter and those with a small diameter so as to substantially eliminate disadvantages inherent in the golf balls having conventional dimples.

Another important object of the present invention is to provide a golf ball of the above described type which may be readily manufactured on a large scale at low cost.

In accomplishing these and other objects, according to one preferred embodiment of the present invention, there is provided a golf ball which includes a golf ball main body, and large dimples having a large diameter A and small dimples having a small diameter B which are respectively formed in a large number on the peripheral surface of the golf ball main body, with the large and small dimples being set in the ratio of the diameters A/B within the range of 1.25 to 1.50. In other words, two kinds of different dimples with the large and small diameters are uniformly arranged on the surface of the golf ball main body.

By the above arrangement according to the present invention as described above, since the two kinds of dimples with large and small diameters are provided, air flow is further disturbed on the surface of the golf ball during flight, thereby increasing the dimple effect. Moreover, owing to the reduction in the difference of the separating point angles according to the positions on the ball surface, the turbulent flow separating region is stabilized with a consequent reduction in the air resistance. In other words, air flows at various cross sections intersecting at right angles with the rotating axis of the golf ball are made uniform, thus making it possible to reduce the difference in angles at the separating points.

It is preferable to set the dimple diameter ratio within the range of 1.25 to 1.50, since the function as described above may be displayed most conspicuously within said range. If this diameter ratio is made less than 1.25, significance for providing the two kinds of large and small dimples is decreased, while on the contrary, if the diameter ratio is set to be larger than 1.50, the diameter of the large dimple exceeds 5 mm, thus it becomes necessary to reduce the depth of the dimple to a large extent, and not only is the performance markedly varied during the repeated use, but the area occupied by the large dimple becomes too large, and thus, the state comes to resemble that when only one kind of dimples is provided.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
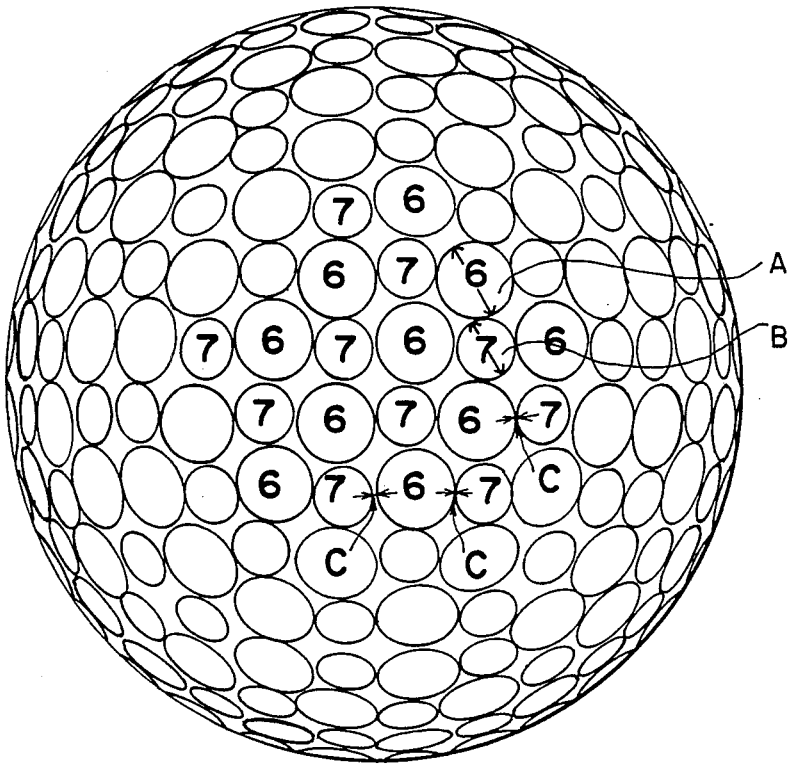
FIG. 1 is a top plan view of a golf ball showing a dimple arranging pattern according to one preferred embodiment of the present invention.

Before the description of the present invention proceeds, it is to be noted that like parts are designated by like reference numerals throughout the accompanying drawings.

Figure 2:
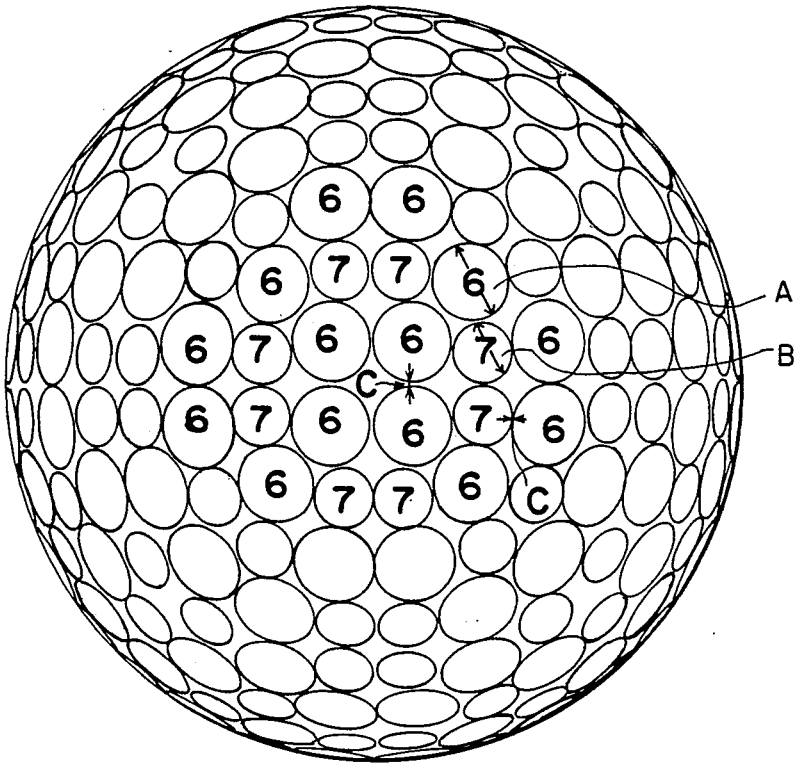
FIG. 2 is a view similar to FIG. 1, which particularly shows dimple arranging patterns according to second and third embodiments of the present invention.
Figure 4:
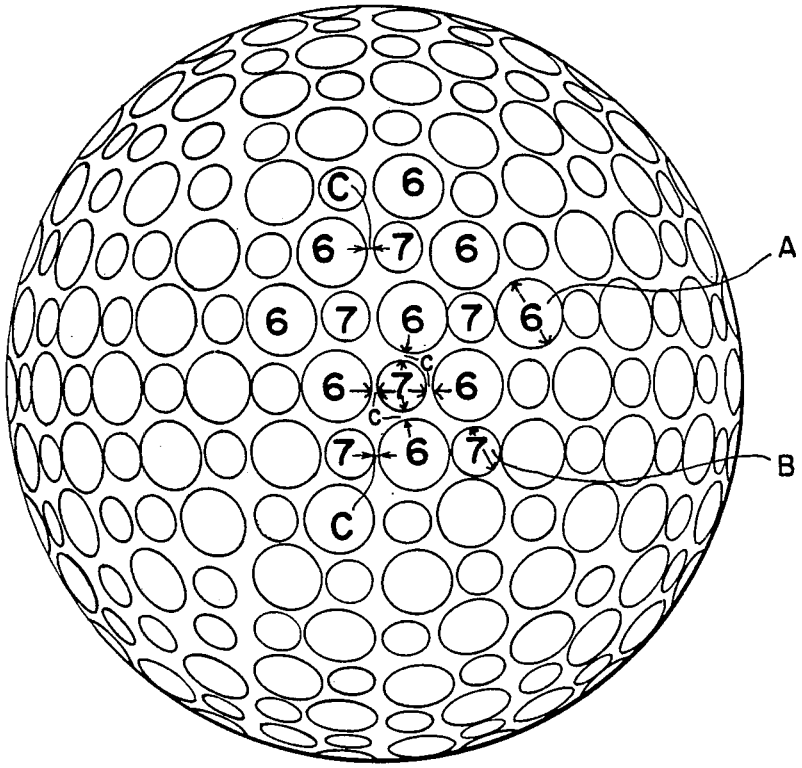
FIG. 4 is a view similar to FIG. 1, which particularly shows a dimple arranging pattern according to a fourth embodiment of the present invention.
Figure 6:
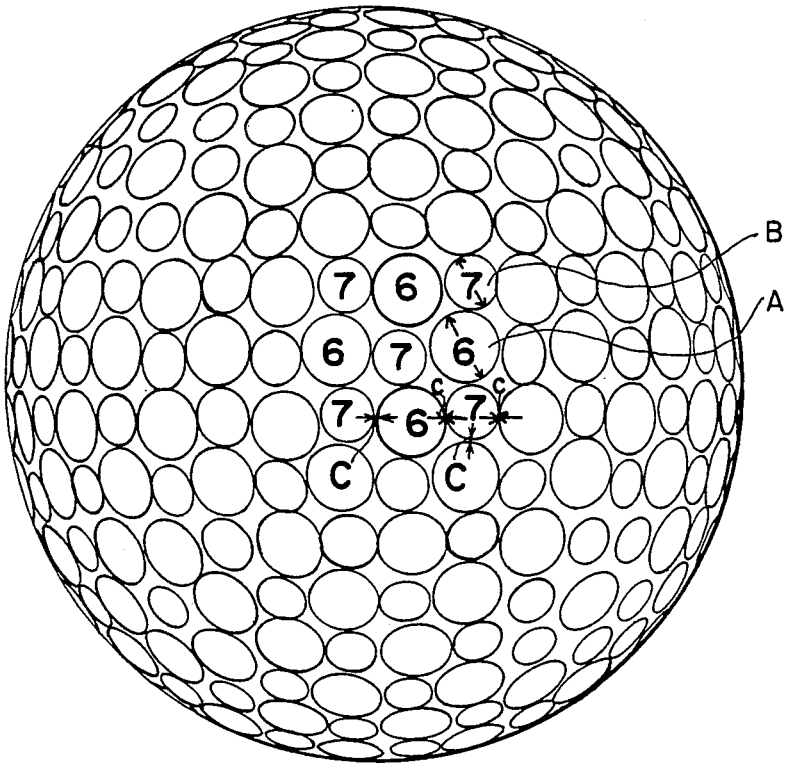
FIG. 6 is a view similar to FIG. 1, which particularly shows a dimple arranging pattern according to a fifth embodiment of the present invention.

Referring now to the drawings, there are specifically shown in FIGS. 1, 2, 4 and 6, golf balls having dimple arranging patterns according to different embodiments of the present invention, in which FIG. 1 shows a first embodiment, FIG. 2 represents second and third embodiments, FIG. 4 denotes a fourth embodiment, and FIG. 6 shows a fifth embodiment.

In any of these embodiments, two kinds of dimples, i.e., large dimples 6 with a large diameter, and small dimples 7 with a small diameter, are formed on the outer peripheral surface of a golf ball main body as illustrated, and a ratio A/B of the diameter A of the large dimple 6 to the diameter B of the small dimple 7 is set in a relation as follows.

$$A/B = 1.25 \sim 1.50$$

Furthermore, the large dimples 6 and the small dimples 7 are arranged in approximately the same number or in exactly the same number, although it is sufficient if the large dimples 6 and the small dimples 7 are each provided generally in the similar large number and a difference therebetween within several tens of dimples may be acceptable.

Meanwhile, as is clear in any of the embodiments in FIGS. 1, 2, 4 and 6, if only any one piece of the large dimples 6 is picked up for observation, it is seen that such a large dimple 6 is located adjacent to at least one piece of the small dimples 7. In other words, none of the large dimples 6 is surrounded only by the same kind of the large dimples.

Similarly, if only any one piece of the small dimples 7 is selected for observation, it is seen that such a small dimple 7 is located adjacent to at least one piece of the large dimples 6 without fail. That is to say, there is no small dimple which is surrounded only by the same kind of small dimples 7.

Moreover, it is preferable that an interval or distance C between the neighboring dimples and 7 (i.e., distance between the dimples) is set within a range of 0 to 0.5 mm. Additionally, the golf ball in the embodiments as illustrated has a spherical surface circumscribed with an imaginary regular polygon, and is formed with the dimples 6 and 7 approximately in the same number or in exactly the same number at portions uniformly sectioned by imaginary lines obtained by spherical projection of edge lines of said regular polygon.

Accordingly, it is preferable that a total dimples volume defined by a following formula is within a range of 250 to 400 mm$^3$.

Total dimples volume $V_T$ $$V_T = V_A + V_B = \frac{0.001}{12} N_A \cdot \pi \left\{ \sum_{k=1}^{n-1} (A_{k-1} \times A_k + 2A_k^2) \right\} + \frac{0.001}{12} N_B \cdot \pi \left\{ \sum_{k=1}^{n-1} (B_{k-1} \times B_k + 2B_k^2) \right\}$$

where $V_T$=total dimples volume, $V_A$=total large dimples volume, $V_B$=total small dimples volume, $N_A$=total number of the large dimples, $N_B$=total number of the small dimples, $A_k$=diameter of the large dimple at a point descended in a direction of depth of k microns from the dimple edge (mm), $B_k$=diameter of the small dimple at a point descended in a direction of depth of k microns from the dimple edge (mm), n=depth of dimple (microns).

Figure 3:
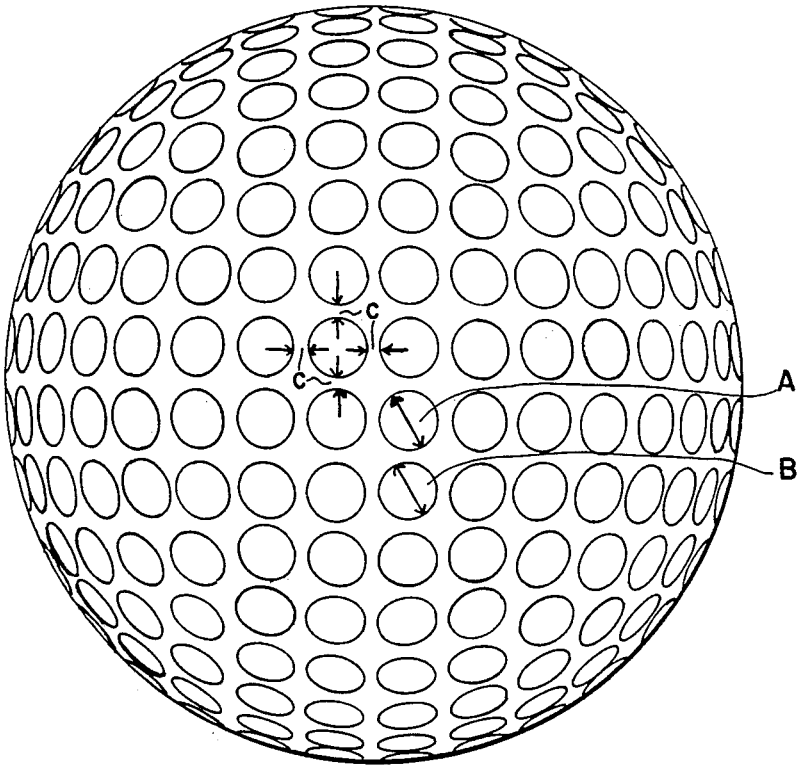
FIG. 3 is a view similar to FIG. 1, which particularly shows a dimple arranging pattern of a first comparative example.
Figure 5:
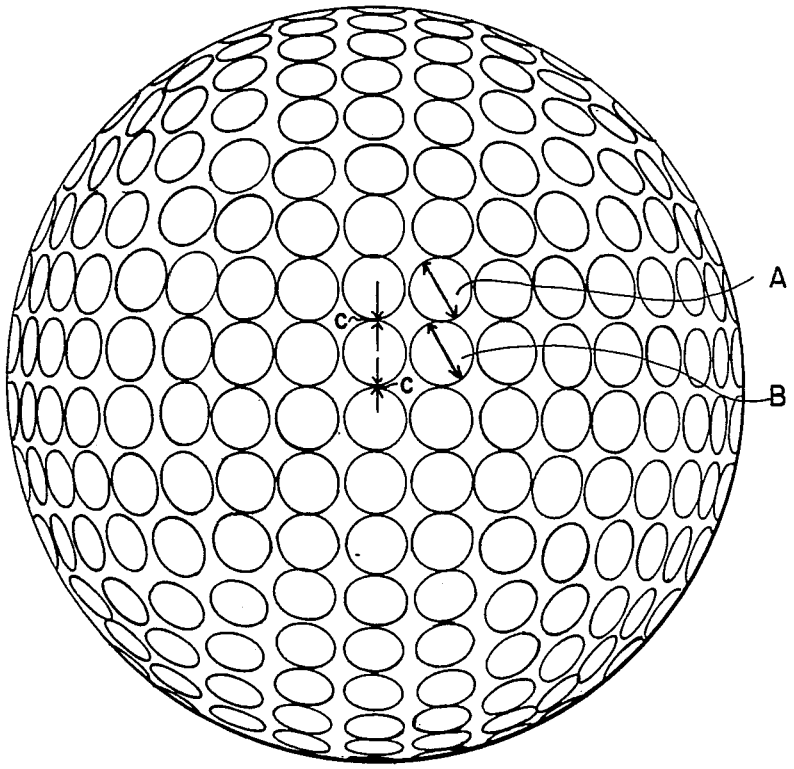
FIG. 5 is a view similar to FIG. 1, which particularly shows a dimple arranging pattern of a fourth comparative example.
Figure 7:
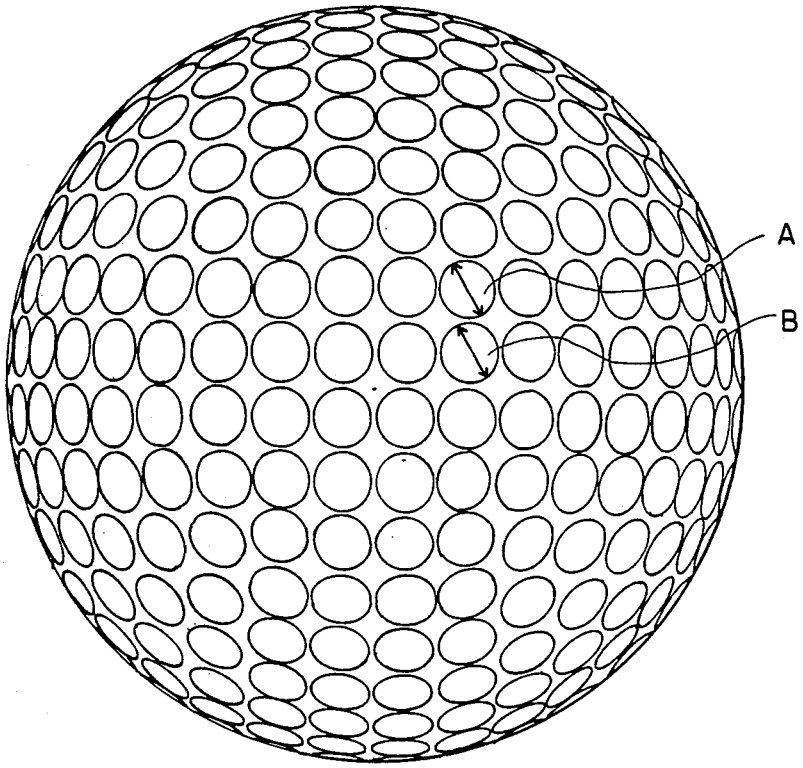
FIGS. 7 and 8 are views similar to FIG. 1, which particularly show dimple arranging patterns of fifth and sixth comparative examples.
Figure 9:
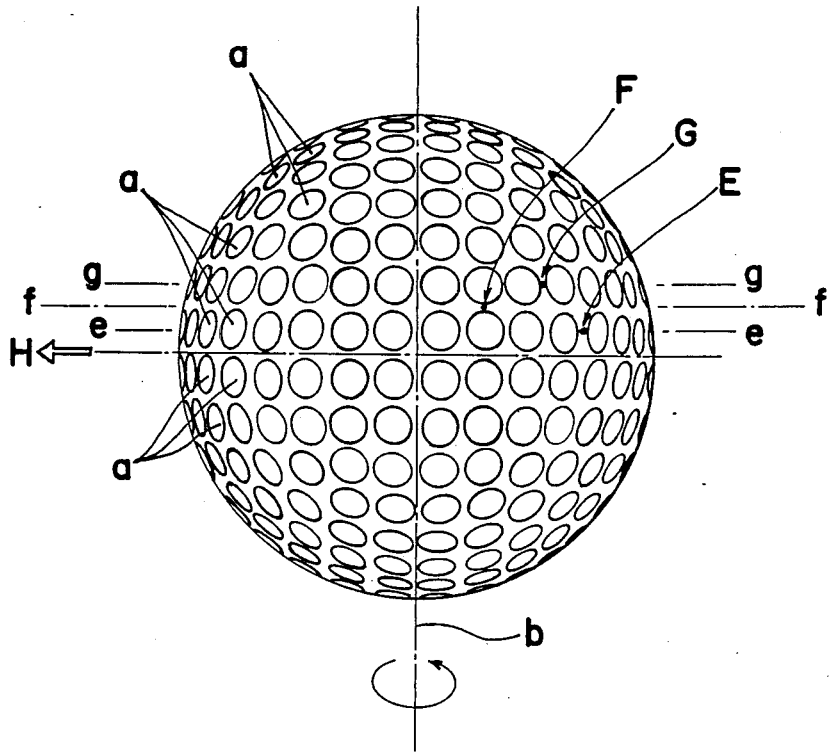
Fig. 9 PRIOR ART
FIG. 9 is a top plan view of a golf ball having a conventional dimple arranging pattern.

As described so far, the embodiments according to the present invention are entirely different from the prior art in FIG. 9 or comparative examples in FIGS. 3, 5 and 7 in that there are provided two kinds of large and small dimples 6 and 7 which are disposed according to a certain rule.

It should be noted here that according to the present invention, although there may be cases where the number of respective dimples is increased or decreased due to omission of part of the dimples for printing a brand mark on the golf ball, or owing to the requirements in the manufacture, the word "about" given in the description is intended to mean inclusion of such a slight increase or decrease in the number as acceptable.

Subsequently, experiments were carried out on the embodiments according to the present invention in order to ensure the effects thereof.

More specifically, through employment of a swing machine identified as M/C which is manufactured by True Temper Co., U.S.A., and is utilized for automatically hitting a golf ball to test it, flight tests were conducted following the test procedures for ODS (Overall Distance Standard) of USGA (United States Golf Association) by the use of a No. 1 wood club, with only the head initial speed being altered into three levels of 49 m/sec, 45 m/sec, and 40 m/sec for evaluation of the results by the difference in flight carries or flying distances. The measurements were evaluated on an average value of 16 pieces of balls for each kind.

Tabulated in Tables 1 and 2 below are the kinds of balls employed for the respective experiments, and the results thereof in the form of lists.

TABLE 1

List of kinds of balls used for respective experiments and results of experiments. (For all embodiments, large size golf balls each having the same number of large and small dimples were used.)

| | | Experiment 1 (balata cover ball) | | | | | |
|---|---|---|---|---|---|---|---|
| Corresponding figure | | Embod. 1 FIG. 1 | Embod. 2 FIG. 2 | Embod. 3 FIG. 2 | Compar. 1 FIG. 3 | Compar. 2 FIG. 1 | Compar. 3 FIG. 1 |
| Total No. of dimples | | 336 | 336 | 336 | 336 | 336 | 336 |
| Large dimple | Dia. A | 4.5 mm | 4.5 | 4.8 | 3.9 | 4.4 | 5.0 |
| | Depth | 0.15 mm | 0.15 | 0.14 | 0.18 | 0.15 | 0.13 |
| Small dimple | Dia. B | 3.4 mm | 3.4 | 3.3 | — | 3.7 | 3.1 |
| | Depth | 0.20 mm | 0.20 | 0.22 | — | 0.18 | 0.22 |
| Ratio A/B | | 1.32 | 1.32 | 1.45 | 1.00 | 1.19 | 1.61 |
| Total dimples volume($mm^3$) | | 360 | 360 | 377 | 364 | 350 | 363 |
| Distance between dimples (mm) | | 0.11 | 0.11 | 0.01 | 0.16 | 0.01 | 0.01 |
| Head speed 49 m/s | Carry (m) | 236 | 235 | 236 | 228 | 230 | 230 |
| | Trajectory height* | 5.8 | 5.8 | 5.7 | 5.6 | 5.9 | 5.7 |
| | Time staying in air (sec) | 5.97 | 6.02 | 5.89 | 5.99 | 6.12 | 5.92 |
| Head speed 45 m/s | Carry (m) | 213 | 211 | 212 | 206 | 207 | 208 |
| | Trajectory height* | 6.5 | 6.4 | 6.4 | 6.2 | 6.6 | 6.5 |
| | Time staying in air (sec) | 5.76 | 5.81 | 5.68 | 5.72 | 5.84 | 5.72 |
| Head speed 40 m/s | Carry (m) | 180 | 179 | 179 | 174 | 175 | 175 |
| | Trajectory height* | 6.8 | 6.8 | 6.8 | 6.7 | 6.7 | 6.7 |
| | Time staying in air (sec) | 5.31 | 5.33 | 5.26 | 5.10 | 5.38 | 5.30 |

*Trajectory height is in index, and actual height (m) is obtained when it is multiplied by constant.

TABLE 2

List of kinds of balls used for respective experiments and results of experiments. (For all embodiments, large size golf balls each having the same number of large and small dimples were used.)

Figure 8:
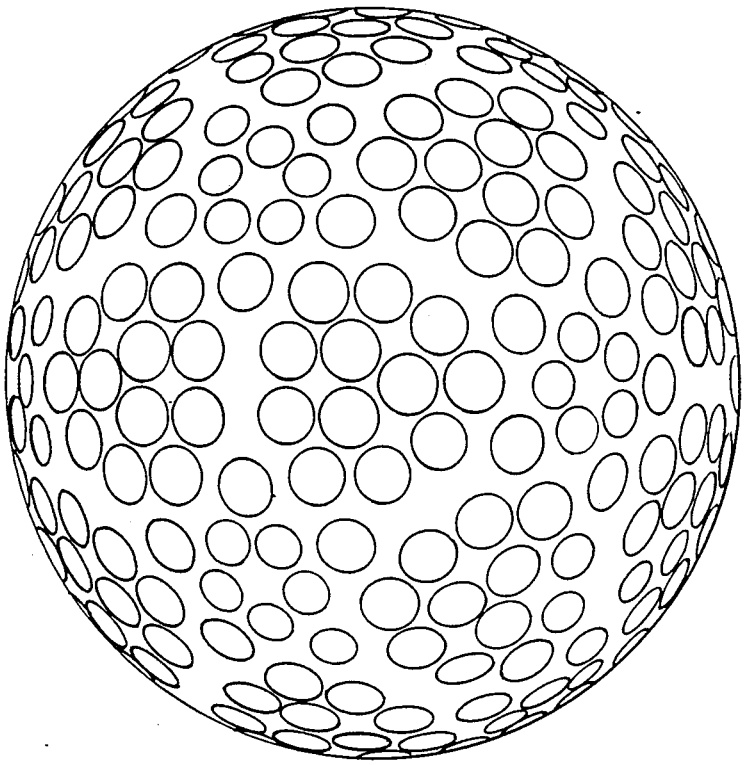

| | | Exper. 2 (2 pc. ball) | | Exper. 3 (ionomer cover ball) | | | |
|---|---|---|---|---|---|---|---|
| Corresponding figure | | Embod. 4 FIG. 4 | Comp. 4 FIG. 5 | Embod. 5 FIG. 6 | Comp. 5 FIG. 7 | Comp. 6 FIG. 8 | Ref. FIG. 3 |
| Total No. of dimples | | 380 | 380 | 416 | 416 | 360 | 336 |
| Large dimple | Dia. A | 4.2 mm | 3.6 | 4.1 | 3.6 | 3.43(120 pcs.),3.18(120 pcs.) | 3.5 |
| | Depth | 0.17 mm | 0.9 | 0.17 | 0.18 | 0.28, 0.28 | 0.26 |
| Small dimple | Dia. B | 3.0 mm | — | 3.0 | — | 3.05(60 pcs.),2.80(60 pcs.) | — |
| | Depth | 0.22 mm | — | 0.22 | — | 0.28, 0.28 | — |
| Ratio A/B | | 1.40 | 1.00 | 1.37 | 1.00 | ? | 1.00 |
| Total dimples volume ($mm^3$) | | 367 | 377 | — | 397 | 391 | 410 |
| Distance between dimples (mm) | | 0.04 | 0.04 | 0 | 0 | ? | 0.6 |
| Head speed 49 m/s | Carry (m) | 236 | 228 | 237 | 232 | 230 | 227 |
| | Trajectory height* | 5.5 | 5.2 | 5.6 | 5.4 | 5.3 | 5.6 |
| | Time staying in air (sec) | 5.80 | 5.64 | 5.91 | 5.73 | 5.60 | 5.78 |
| Head speed 45 m/s | Carry (m) | 215 | 208 | 214 | 208 | 207 | 205 |
| | Trajectory height* | 6.2 | 6.0 | 6.3 | 6.1 | 6.0 | 6.2 |
| | Time staying in air (sec) | 5.61 | 5.46 | 5.70 | 5.56 | 5.46 | 5.66 |
| Head speed 40 m/s | Carry (m) | 185 | 179 | 183 | 179 | 178 | 176 |
| | Trajectory height* | 6.6 | 6.4 | 6.7 | 6.5 | 6.5 | 6.6 |
| | Time staying in air (sec) | 5.19 | 5.04 | 5.25 | 5.16 | 5.12 | 5.20 |

*Trajectory height is in index, and actual height (m) is obtained when it is multiplied by constant.

Hereinbelow, details of embodiments 1 through 5 in the above Tables 1 and 2 are described.

Embodiment 1

In the pattern having 336 dimples in the total number and arranged as shown in FIG. 1, the large dimples in 168 pieces each having the diameter A of 4.5 mm and depth of 0.15 mm, and the small dimples in 168 pieces each having the diameter B of 3.4 mm and depth of 0.20 mm were formed at the ratio A/B of 1.32, dimple interval of 0.11 mm, with the total dimples volume of 360 $mm^3$, and the large size balata cover thread wound golf ball was produced.

For the center, a 28.5 mm liquid center was employed to prepare the golf ball having a hardness of 100, and initial speed of 254 ft/sec.

Embodiment 2

The golf ball was produced in the similar manner as in the first embodiment, except for altering the dimple arranging pattern as in FIG. 2.

Embodiment 3

In the pattern having 336 dimples in the total number and arranged as shown in FIG. 2, the large dimples in 168 pieces each having the diameter A of 4.8 mm and depth of 0.14 mm, and the small dimples in 168 pieces each having the diameter B of 3.3 mm and depth of 0.22 mm were formed at the ratio A/B of 1.45, dimple interval of 0.01 mm, with the total dimples volume of 377 $mm^3$, and in other points, the golf ball was formed in the similar manner as in embodiment 1.

Embodiment 4

In the pattern having 380 dimples in the total number and arranged as shown in FIG. 4, the large dimples in 190 pieces each having the diameter A of 4.2 mm and depth of 0.17 mm, and the small dimples in 190 pieces each having the diameter B of 3.0 mm and depth of 0.22 mm were formed at the ratio A/B of 1.40, dimple interval of 0.04 mm, with the total dimples volume of 367 $mm^3$, and the large size 2 piece golf ball was produced, following embodiment 1 in Japanese Laid-Open patent application Tokkaisho No. 59-57675.

Embodiment 5

In the pattern having 416 dimples in the total number and arranged as shown in FIG. 6, the large dimples in 208 pieces each having the diameter A of 4.1 mm and depth of 0.17 mm, and the small dimples in 208 pieces each having the diameter B of 3.0 mm and depth of 0.22 mm were formed at the ratio A/B of 1.37, dimple interval of 0 mm, with the total dimples volume of 397 $mm^3$, and the large size ionomer cover thread wound golf ball was produced.

For the center, a 30.5 mm solid center was used, while for the cover, a material prepared by adding a coloring agent to Surlyn #1605 (name used in trade and manufactured by Du Pont) was employed to prepare the golf ball having a hardness of 95 and initial speed of 254 ft/sec.

Furthermore, details of experiments 1 to 3 in Tables 1 and 2, and explanation of comparative examples 1 to 6 also listed therein will be given hereinafter.

Experiment 1

Comparison was made between embodiments 1 to 3 and comparative examples 1 to 3 with respect to the large size balata cover thread wound golf balls. The golf ball of comparative example 1 having one kind of dimples (conventional golf ball in FIG. 3), golf ball of comparative example 2 with the dimple diameter ratio A/B of 1.19 as a representative of the golf balls having the dimple diameter ratios less than 1.25, and golf ball of comparative example 3 with the dimple diameter ratio A/B of 1.61 as a representative of the golf balls having the dimple diameter ratios larger than 1.50, were subjected to hitting for comparison with those of embodiments 1 to 3.

The golf balls were respectively subjected to M/C adjustments to meet the requirements as follows.

Head speed 49 m/s, launch angle 8.9, spin 3200 rpm
Head speed 45 m/s, launch angle 10.3, spin 3500 rpm
Head speed 40 m/s, launch angle 11.8, spin 3400 rpm As the result of the above experiment, in comparison with comparative experiments 1 to 3, embodiments 1 to 3 showed an increase in the flight carry of 5 to 7 m at the head speed of 49 m/s, increase in the flight carry of 3 to 7 m at the head speed of 45 m/s, and increase in the flight carry of 4 to 6 m at the head speed of 40 m/s, and thus, the effect for the flight carry increase in the dimple diameter ratios at 1.25 to 1.50 was ensured.

Experiment 2 (dimple number 380)

In the arrangement of the dimple number 380, the golf balls with large and small dimples were compared with those having uniformly positioned dimples. Both for comparative example 4 having one kind of dimples (conventional golf ball in FIG. 5) and embodiment 4, large size 2 piece golf balls were employed, with M/C adjustments to meet the following requirements.

Head speed 49 m/s, launch angle 9.7, spin 2800 rpm
Head speed 45 m/s, launch angle 11.2, spin 3000 rpm
Head speed 40 m/s, launch angle 12.9, spin 3000 rpm As the result of the above experiment, in comparison with comparative experiment 4, ,embodiment 4 showed an increase in the flight carry of 8 m at the head speed of 49 m/s, increase in the flight carry of 7 m at the head speed of 45 m/s, and increase in the flight carry of 6 m at the head speed of 40 m/s, and the effect for the flight carry increase by the combination of the two kinds of large and small dimples was confirmed.

Experiment 3 (dimple number 416)

In the arrangement of the dimple number 416, the golf balls with large and small dimples were compared with those having uniform dimples. Comparative example 5 relates to the golf ball having one kind of dimples (conventional golf ball in FIG. 7 as disclosed in Japanese Laid-Open patent application Tokkaisho No. 60-111665). Comparative example 6 is quoted for reference as an example in which a plurality of kinds of dimples are simultaneously present in the dimple arrangement of 360 pieces as disclosed, for example, in the embodiment of Japanese patent Publication Tokkosho No. 57-22595.

Comparison between embodiment 5 and comparative examples 5 and 6 were effected with respect to the large size ionomer cover golf balls, with M/C adjustments to meet the requirements as follows.

Head speed 49 m/s, launch angle 9.3, spin 3000 rpm
Head speed 45 m/s, launch angle 10.6, spin 3300 rpm
Head speed 40 m/s, launch angle 12.4, spin 3200 rpm As the result of the above experiment, in comparison with comparative experiment 5, embodiment 5 showed an increase in the flight carry of 5 m at the head speed of 49 m/s, increase in the flight carry of 6 m at the head speed of 45 m/s, and increase in the flight carry of 4 m at the head speed of 40 m/s, and the effect for the flight carry increase by the combination of the two kinds of large and small dimples was confirmed.

It is to be noted that the result of comparative experiment 6 is inferior to that of comparative experiment 5 in terms of the flight carry. For reference with respect to comparative experiment 6, the golf ball of the same construction with one kind of dimples of 336 pieces in number was hit for comparison.

As is clear from the foregoing description, according to the present invention, by the construction in which the two kinds of large and small dimples 6 and 7 respectively in large numbers and having the dimple ratios A/B of 1.25 to 1.50, are provided on the surface of the golf balls, the separating point of the golf balls during the flight is stabilized, whereby the flight performance not present in the conventional techniques may be achieved for the increase of the flight carry. Furthermore, with respect to the shape of the trajectory, the undesirable "hop" which may take place when it is intended to increase the flight carry is not produced, and the golf ball is allowed to fly straight, extending over a sufficient distance, without being readily affected by wind.

Although the present invention has been fully described by way of example with reference to the accompanying drawings, it is to be noted here that various changes and modifications will be apparent to those skilled in the art. Therefore, unless otherwise such changes and modifications depart from the scope of the present invention they should be construed as being included therein.

What is claimed is:

1. A golf ball containing improved aerodynamic characteristics and enhanced flying performance which comprises a golf ball main, dimples having a large diameter A and dimples having a small diameter B, being disposed in numbers of 336, 380, or 416 or slight variances therefrom, on the peripheral surface of said golf ball main body, said large and small dimples having a diameter ratio A/B within the range of 1.25 to 1.50, said large diameter dimples and said small diameter dimples being provided in approximately the same number on the surface of said golf ball main body, said large and small diameter dimples being arranged uniformly on the peripheral surface of said golf ball main body in such a manner that all of said large diameter dimples are located adjacent to at least one of said small diameter dimples, and all of said small diameter dimples are located adjacent to at least one of said large diameter dimples, and wherein an average interval C between the dimples adjacent to each other is within the range of 0 to 0.5 mm.

2. A golf ball as claimed in claim 1, having a total dimples volume represented by a formula, $$V_T = V_A + V_B = \frac{0.001}{12} N_A \cdot$$

-continued $$\pi\left\{\sum_{k=1}^{n-1} (A_{k-1} \times A_k + 2A_k^2)\right\} + \frac{0.001}{12} N_B \cdot \pi\left\{\sum_{k=1}^{n-1} (B_{k-1} \times B_k + 2B_k^2)\right\}$$

where $V_T$=total dimples volume, $V_A$=total large dimples volume, $V_B$=total small dimples volume, $N_A$=total number of the large dimples, $N_B$=total number of the small dimples, $A_k$=diameter of the large dimple at a point descended in a direction of depth of k microns from the dimple edge (mm), $B_k$=diameter of the small dimple at a point descended in a direction of depth of k microns from the dimple edge (mm), n=depth of dimple (microns), said total dimples volume being set in the range of 250 to 400 $mm^3$.

3. The golf ball as claimed in claim 2, wherein the total number of the dimples is 336, with the number of each of the large dimples and the small dimples being about 168, the large diameter A of the large dimples being in the range of 4.3 to 4.9 mm, with the small diameter B of the small dimples being in the range of 3.0 to 3.6 mm.

4. The golf ball as claimed in claim 2, wherein the total number of the dimples is 380, with the number of each of the large dimples and the small dimples being about 190, the large diameter A of the large dimples being in the range of 3.8 to 4.4 mm, with the small diameter B of the small dimples being in the range of 2.6 to 3.2 mm.

5. The golf ball as claimed in claim 2, wherein the total number of the dimples is 416, with the number of each of the large dimples and the small dimples being about 208 pieces, the large diameter A of the large dimples being in the range of 3.7 to 4.3 mm, with the small diameter B of the small dimples being in the range of 2.5 to 3.1 mm.

* * * * *